US005477011A

United States Patent [19]

Singles et al.

[11] Patent Number: 5,477,011

[45] Date of Patent: Dec. 19, 1995

[54] LOW NOISE SIGNAL TRANSMISSION CABLE

[75] Inventors: David T. Singles; Grant Walter, both of Newark, Del.; William P. Mortimer, Jr., Conowingo, Md.

[73] Assignee: W. L. Gore & Associates, Inc., Newark, Del.

[21] Appl. No.: 206,319

[22] Filed: Mar. 3, 1994

[51] Int. Cl.[6] ..... H01B 7/34

[52] U.S. Cl. ..... 174/102 R; 174/36; 174/106 R; 174/106 SC; 174/109

[58] Field of Search ..... 174/102 R, 102 SC, 174/106 SC, 106 R, 107, 109, 36

[56] References Cited

U.S. PATENT DOCUMENTS

| | | | |
|---|---|---|---|
| 3,433,687 | 3/1969 | Price | 156/47 |
| 3,567,846 | 3/1971 | Brorein et al. | 174/36 |
| 3,681,515 | 8/1972 | Mildner | 174/107 |
| 3,698,670 | 10/1972 | Mitacek | 174/107 |
| 3,745,232 | 7/1973 | Johnson et al. | 174/107 |
| 3,953,566 | 4/1976 | Gore | 264/288 |
| 4,376,920 | 3/1983 | Smith | 174/36 |
| 4,472,595 | 9/1984 | Fox et al. | 174/36 |
| 4,691,081 | 9/1987 | Gupta et al. | 174/105 R |
| 4,701,576 | 10/1987 | Wada et al. | 174/117 F |
| 5,008,489 | 4/1991 | Weeks, Jr. et al. | 174/36 |
| 5,210,377 | 5/1993 | Kennedy et al. | 174/107 |
| 5,235,132 | 8/1993 | Ainsworth et al. | 174/36 |
| 5,262,591 | 11/1963 | Aldissi | 174/36 |

FOREIGN PATENT DOCUMENTS

| | | |
|---|---|---|
| 0061829 | 10/1982 | European Pat. Off. . |
| 9315512 | 8/1993 | WIPO . |

OTHER PUBLICATIONS

International Search Report for PCT/US94/11899 (2 pages).

Literature: "Special Audio, Communication, and Instrumentation Cables Low Tribo–electric Noise Coaxial Cables"; Belden Cooper Ind.;Date: Unknown; p. 260.

Literature: "Mini–Noise" Coaxial Cable; Malco Microdot Inc.; pp. 16–19; Date: Unknown.

Literature: "Extrusion Foaming of Coaxial Cables of Melt–Fabricable Fluorocarbon Resins"; Author: Stuart K. Randa; DuPont Co.; Date: Nov. 18, 1981.

*Primary Examiner*—Morris H. Nimmo

*Attorney, Agent, or Firm*—David J. Johns

[57] ABSTRACT

An improved low noise electrical signal transmission cable is disclosed. The cable employs an insulative layer of expanded polytetrafluoroethylene (PTFE) which is bonded in fixed relative position with a surrounding shield layer through use of an adhesive, such as fluorinated ethylenepropylene (FEP) or perfluoroalkoxy polymer (PFA). The bonding process reduces the separation of layers which can sometimes occur with expanded PTFE insulative cables and avoids the generation of unwanted triboelectric signals that can result from such separation.

13 Claims, 2 Drawing Sheets

LOW NOISE SIGNAL TRANSMISSION CABLE

BACKGROUND OF THE INVENTION

1. Field of the Invention

The present invention relates electrical cables for transmitting electrical signals, and especially cables which transmit with high signal fidelity.

2. Description of Related Art

Traditional low signal level cable designs (also referred to as "low noise" and "low triboelectric effect" wires or cables) have used full density materials such as polyethylene or a fluoropolymer such as fluorinated ethylenepropylene (FEP) or polytetrafluoroethylene (PTFE) for their dielectric insulation. These dielectrics are then further insulated with a layer of carbon impregnated PTFE or silicon. This additional layer acts as a semi-conductive layer to attenuate charges originating in shielding for the cable.

Unfortunately, full density insulators like PTFE suffer from a high capacitance which can limit their performance in certain high demand applications, such as in high gain audio amplifiers, oscilloscope probes, piezoelectric components (e.g., microphones, accelerometers and eddy current sensors). Capacitance (C) in this instance is defined as:

$$C(\text{picofarads/ft}) = \frac{7.4\,\epsilon_{eff}}{\text{Log}\,Dd}$$

Where $\epsilon_{eff}$=effective dielectric constant; D=diameter over the dielectric; and d=diameter over the center conductor. Typical capacitance values in commercially available products today range from 28–30 Pf/ft in 50 ohm designs. For many demanding applications, far better capacitance performance is desirable.

Expanded PTFE insulation, such as that which can be made in accordance with U.S. Pat. No. 3,953,566 to Gore, has many desirable properties over full density fluoropolymer insulations, including lower dielectric constant, improved matrix tensile strength, lighter weight, etc. Although expanded PTFE insulative material provides improved dielectric performance, it generally has not been used in many low signal applications because of triboelectric capacitive effect between metallic elements (e.g., cable shield and/or conductor) and the expanded PTFE insulation aggravated by the presence of air entrapped within the expanded PTFE. This condition can lead to "noisy" performance by the cable due to static charges generated by the cable under flex.

Accordingly, it is a primary purpose of the present invention to provide an improved low-noise electrical insulation which has low dielectric constant.

It is another purpose of the present invention to provide an improved electrical insulation which incorporate desirable insulative properties of expanded PTFE while maintaining structural integrity between layers of insulation.

It is still another purpose of the present invention to provide an improved electrical insulation which has a reduced tendency to generate triboelectric interference even without an added static dissipating layer.

These and other purposes of the present invention will become evident from review of the following specification.

SUMMARY OF THE INVENTION

The present invention is a low noise cable suitable for use in sensitive electrical signal transmission. The cable of the present invention employs an insulative layer of expanded polytetrafluoroethylene (PTFE) which is bonded using an adhesive, such as FEP and/or PFA, directly or indirectly to a surrounding shield layer in order to maintain fixed relative position between the insulative layer and the shield layer during use. The bonding process produces a tightly coherent interface between the insulative layer and the shield which is resistant to separation and movement during use.

By eliminating separation of the PTFE insulative layer, "noise" in the form of triboelectric currents are significantly reduced in the cable of the present invention while retaining the beneficial insulative and other qualities of expanded PTFE. The bonding process of the present invention is so successful that for some applications a low noise semi-conductive layer commonly used to dissipate triboelectric currents in low noise cables may not be necessary. In those instances where the semi-conductive layer is provided, the bonding process may likewise be used with it to form the insulative layer, the semi-conductive layer, and the shield layer into a single coherent unit. A further improvement of the present invention is to bond the conductor to the insulative layer, providing an even more cohesive final cable.

The cable of the present invention provides a number of significant benefits, including lower capacitance, smaller size, lighter weight, improved flexibility, and reduced susceptibility to damage during use. Further, the process of producing a low-noise cable is likewise improved by the present invention, including reduced manufacturing time and expense, ease in connector assembly, reduced material costs.

DESCRIPTION OF THE DRAWINGS

The operation of the present invention should become apparent from the following description when considered in conjunction with the accompanying drawings, in which.

DETAILED DESCRIPTION OF THE INVENTION

The present invention comprises an improved low noise cable for the transmission of electrical signals. While the cable of the present invention is particularly suited for use in transmitting signals between sensitive apparatus, the cables of the present invention may be applied to virtually any application where electrical signals must be conveyed accurately, such as wires for high gain amplifiers, cables for oscilloscope probes, connectors for piezoelectric components (e.g., microphones, accelerometers, eddy current sensors), etc.

Figure 1:
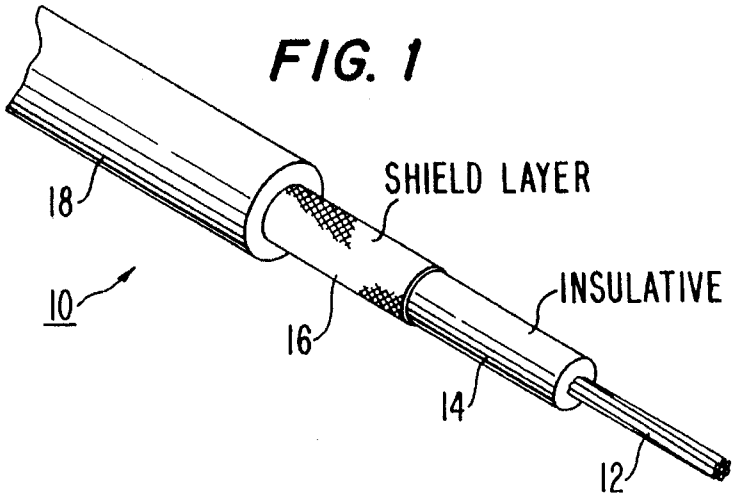
FIG. 1 is a three-quarter perspective view of one embodiment of a cable of the present invention.
Figure 2:
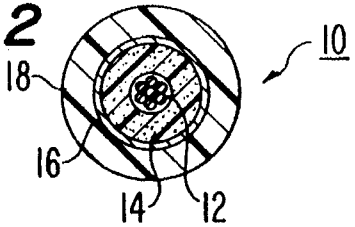
FIG. 2 is a cross-sectional view of the cable shown in FIG. 1.

Shown in FIGS. 1 and 2 is a first embodiment of a cable 10 of the present invention. Cable 10 comprises: a conductor 12, in this instance a multiple strand conductor comprising seven strands of silver plated copper wire; an insulative layer 14 of expanded polytetrafluoroethylene (PTFE) surrounding the conductor, such as expanded PTFE tape made in accordance with U.S. Pat. No. 3,953,566 issued Apr. 27, 1976, to Gore; a shield layer 16, such as a metal braid shield material; and an outer insulative jacket 18, such as expanded or fully density PTFE, fluorinated ethylenepropylene (FEP), or perfluoroalkoxy polymer (PFA).

As has been noted, a problem with previous attempts to construct a low noise cable in this manner has been that during use, and particularly under conditions requiring substantial flexing or vibration of the cabling during use, the expanded PTFE insulative layer tends to separate from conductive shield layer 16 and/or the conductor 12. Separation of this nature can then lead to the generation of triboelectric currents when the insulation layer rubs against the conductive elements during use. The "noise" generated by this condition simply cannot be tolerated by highly sensitive electronic equipment.

To correct this problem, the present invention employs an adhesive, and preferably a fluoropolymer adhesive, to bond at least the insulative layer 14 and the shield layer 16 in fixed relative position with each other. As is explained in detail below, this bonding process may comprise direct adhesion between the insulative layer and the shield layer or adhesion of both layers to an intermediate structure. The purpose is to establish a coherent structure which resists separation and relative movement between the insulative layer and the shield layer during use.

Suitable fluoropolymer adhesive for use with the present invention include fluorinated ethylenepropylene (FEP) and perfluoroalkoxy polymer (PFA) (e.g., TEFLON FEP 100 or TE-9787 PFA dispersion, each available from E. I. dupont de Nemours and Company, Wilmington, Del.), as well as coated adhesives, such as polyesters, polyurethanes, etc.

Preferably, the insulative layer and the shield layer are bonded directly or indirectly together after the cable has been fully assembled by applying heat or other activation energy to the cable. In this manner, a firmly coherent structure can be provided which is highly resistant to separation during use.

Most preferably, the cable is constructed in the following manner. A non-expanded or slightly expanded (e.g., 2:1 expansion) substrate of PTFE is laminated to a film layer of thermoplastic fluorinated ethylenepropylene (FEP), such as FEP 100 available from E. I. dupont and Company, to form a composite. Lamination should occur at a temperature above the melt temperature of the thermoplastic. The laminate is then further stretched at a temperature above the melt of the thermoplastic (e.g., at a ratio of 2:1 to 100:1 or more), drawing the composite down to a high strength material. One suitable procedure for processing PTFE in this manner is disclosed in U.S. Pat. No. 3,953,566 to Gore, incorporated by reference. This produces a high strength composite with very thin layers of expanded PTFE and FEP.

Additionally, or alternatively, the expanded PTFE may be treated with a perfluoroalkoxy polymer (PFA) material, such as TE-9787 PFA dispersion or a TEFLON PFA 340 material, each available from E. I. dupont and Company. The PFA may be incorporated into the PTFE structure in any suitable manner, such as by dry blending or co-coagulation to make powders for dough or paste extrusion processes.

Preferably, the PFA is incorporated through a procedure similar to that disclosed in U.S. Pat. No. 4,985,296 to Mortimer, incorporated by reference. Specifically, the PFA is combined in the following manner. First, a PFA dispersion or powder is thoroughly mixed with a PTFE dispersion or powder. If one or both of the components is a dispersion, the mixed material is then dried to a powder form. The resulting powder is then lubricated, such as with mineral spirits, and then calendered, cross-calendered, extruded, or worked to a desired thickness (e.g., 1 to 50 mils). The worked material can then be stretched at an elevated temperature to produce an expanded PTFE material. Finally, the lubricant is removed, such as through evaporating at elevated temperature. Using this procedure, the PFA material tends to become embedded within the nodal structure of the expanded PTFE.

In addition to the above processes, a variety of other procedures may be used to apply an adhesive to the PTFE material. Other suitable procedures include: producing a PFA tape in a manner similar to that described above concerning the production of an FEP tape; applying an adhesive-filled laminate to the PTFE material to act as an adhesive layer; filling the PTFE with FEP in the manner similar to that described above as relating to PFA filling; or combining one or more of the above procedure, such as using both an adhesive fill and an adhesive tape or laminate. Finally, although PFA and FEP are the preferred adhesives for use with the present invention, other adhesives may also be used, such as polyesters, ethylene tetrafluoroethylene (ETFE) (e.g., TEFZEL polymer available from E. I. duPont and Company).

While a high temperature adhesive such as PFA or FEP is preferred for use in the present invention, it should be appreciated that any thermoplastic or other adhesive system may be used with successful results in low temperature or other less demanding applications.

Once the expanded PTFE material is treated in the above described manner, the cable is then fully assembled into its completed form. Once assembled, bonding between the insulative layer 14 and shield layer 16 (and the conductor 12, if desired) can then be readily accomplished by simply applying heat to the finished cable to activate the FEP and/or PFA materials. While the amount and time of heat treatment is heavily dependent on the specific size and characteristics of each cable, a heat treatment of 390° to 430° C. for 5 to 20 seconds is believed suitable for most applications.

Insulative layers 14 which can be used in the present invention are preferably a composite of adhesive and an expanded PTFE material, such as those made in accordance with U.S. Pat. No. 3,955,566 to Gore, incorporated by reference. In its easiest to use form, the insulative layer comprises a tape cut from a sheet of expanded PTFE material which is wrapped around the conductor (e.g., helically wrapped, or longitudinally wrapped (i.e., in a cigarette fashion)). Alternative insulative layers that may be used with the present invention include foamed expanded FEP, extruded expanded PTFE, expanded porous polyethylene, etc. Some of the advantages of using one of these other insulative materials, such as FEP or polyethylene, are: reduced material expensive; possibly more uniformity; and possible elimination of need for a separate adhesive. material.

Shield layers 16 which can be used in the present invention include any appropriate electrically conductive material that can be bonded to the insulative layer. Among the suitable presently available shielding materials are: braided metal shield; conductive polymer shield; served wire shield; helically wrapped foil shield; cigarette wrapped shield; metallized film shield (e.g., aluminized polyester). Additionally, in some instances it may be possible to provide a suitable bond by applying an adhesive layer to the interior of the shield itself in order to establish the bond with the insulative layer.

Cables made with the construction shown in FIGS. 1 and 2 have demonstrated good low noise characteristics, even without use of a low noise conductive layer commonly used to dissipate triboelectric currents in low noise cables. Typical electrical properties for a cable of this construction include: impedance of 55±5 ohms; a nominal capacitance of 23 pf/ft; velocity of propagation of 87% of air; and a center conductor resistance of 0.097 ohms/ft.

Figure 3:
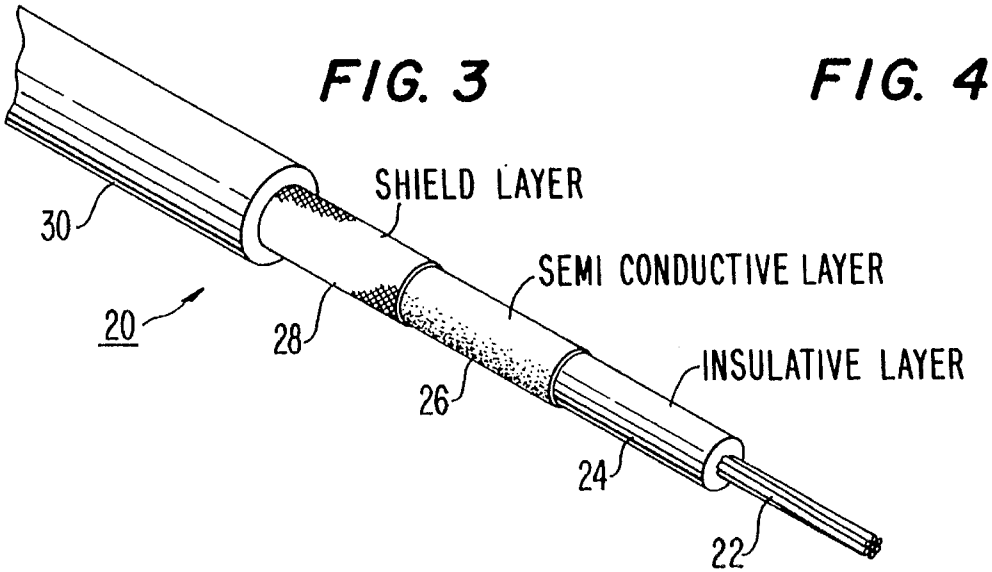
FIG. 3 is a three-quarter perspective view of another embodiment of a cable of the present invention.
Figure 4:
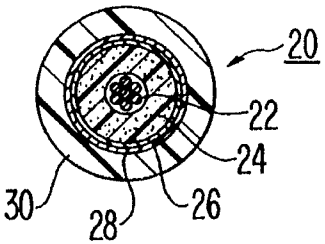
FIG. 4 is a cross-sectional view of the cable shown in FIG. 3.

Shown in FIGS. 3 and 4 is another construction of a cable 20 of the present invention. In this instance, the cable comprises: a conductor 22, such as multiple strand silver plated copper; an insulative layer 24 of expanded PTFE; a low noise semi-conductive layer 26, such as conductive particle filled PTFE (e.g., carbon filled tape with or without an adhesive laminated on one side); a shield layer 28; and an insulative jacket 30.

The construction of FIGS. 2 and 3 differs from that shown in FIGS. 1 and 2 primarily in the addition of the low noise semi-conductive layer 26. While "noise" is vastly reduced through use of the cable construction of the present invention, the inclusion of semi-conductive layer 26 assures that a pathway is present for the ready dissipation of any triboelectric currents that may be generated during use of the cable.

The semi-conductive layer 26 may be constructed with a variety of materials and incorporating a variety of different properties. Examples of such layers include: dense carbon filled materials, metal filled or metal plated materials, and undensified (conformable) materials. Suitable materials for the semi-conductive layer 26 include, without limitation, metal or carbon filled expanded PTFE, and metal or carbon coated polyester or other polymer film.

In the preferred construction of the cable shown in FIGS. 3 and 4, prior to construction both the insulative layer 24 and the semi-conductive layer 26 are laminated with a layer of FEP and/or coated with a PFA material in the manner previously described. Once the cable 20 is assembled into its final form, heat or other activation energy can be applied to bond the conductor 22, the insulative layer 24, the semi-conductive layer 26, and the shield layer 28 into a coherent unit.

Typical electrical properties for a cable of this construction include: impedance of 50±5 ohms; capacitance of 29 pf/ft; nominal velocity of propagation of 75% of the speed of light; and center conductor resistance of 0.097 ohms/ft.

Figure 6:
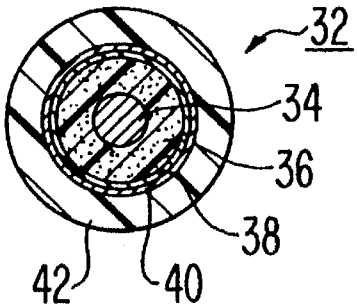
FIG. 6 is a cross-sectional view of the cable shown in FIG. 5.
Figure 5:
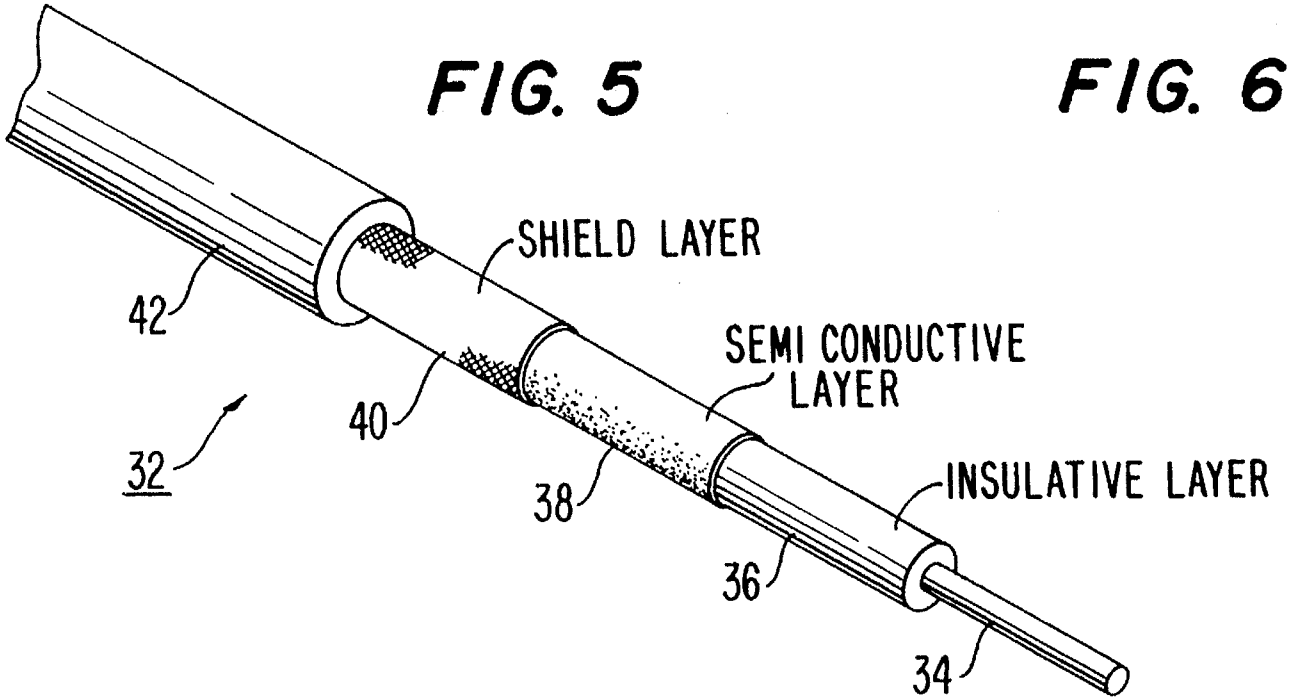
FIG. 5 is a three-quarter perspective view of still another embodiment of a cable of the present invention.

Shown in FIGS. 5 and 6 is still another embodiment of a cable 32 of the present invention. This construction comprises: a single strand conductor 34; a PFA filled expanded PTFE insulative layer 36; a low noise conductive layer 38; a shield layer 40; and an insulative jacket 42. The application of heat to the PFA filled expanded PTFE insulative layer 36 serves to bond the conductor 34, the insulative layer 36, and the semi-conductive layer 38 into a coherent unit.

Typical electrical properties for a cable of this construction include: impedance of 50±5 ohms; nominal capacitance of 25 pf/ft; and nominal velocity of propagation of 75% of the speed of light.

Without intending the limit the scope of the present invention, the following examples demonstrate how the present invention may be made and used:

EXAMPLE 1

An expanded PTFE tape was prepared with a filling of PFA adhesive in the following manner:

A 0.25 lb quantity of PFA350 powder (80 micron), acquired from E. I. dupont and Company, was added to 625 cc of mineral spirits and blended for about 1 minute. This mixture was then added to 5 lbs of TE-3525 PTFE fine power, acquired from E. I. dupont and Company, and blended for approximately 8 minutes. A pre-form was then made from this blended material, applying about 25 in Hg vacuum and 430 psi pressure. The pre-form was then ram extruded at ambient conditions through a flat die at 2326 psi hydraulic pressure to form a tape.

Once the tape was formed, it was calendered in two passes through heated rolls to 3.8 mils thickness. The mineral spirits were then dried across heated rolls (maximum temperature about 300° C.) and stretched simultaneously at a maximum temperature of about 225° C. at a ratio of 4:1 and an output speed of 130 ft/min. Finally, the tape was sintered at 369° C. across heated rollers at 130 ft/min and at a ratio of 1:1. The resulting tapes had a bulk density of 0.675 g/cc and had an average thickness of 2.9 mils.

The PFA filled tape was then helically wrapped as an insulative layer over a silver plated copper wire (AWG 30 (7/38)) to a diameter of 0.032" (0.081 cm). Using a conventional braiding machine, a braided shield, comprising a AWG 38[(1)] SPC wire with 20 picks per inch and 3 ends, was wrapped over the taped wrapped wire. A closing die was used to apply compression. The braided cable had a 0.047" (0.119 cm) outside diameter (OD). The shielded cable was then exposed to heat in a convection oven of 410° C. for about 10 seconds to activate the adhesive.

Following heat treatment, an extruded. PFA jacket was then added with a wall thickness of 0.010" (0.025 cm), producing a final cable OD of 0.067" (0.17 cm).

The final cable had the following properties:

Impedance of 55±5 ohms

Velocity of Propagation of 87%

Capacitance of 23 pico farads/ft

Noise test (voltage) of 0 millivolts

Noise test (current) of 1.94 picoamps

The noise tests for voltage and current were carried out in accordance with the following procedure. A "bowstring" type excitation apparatus was built to support a length of cable under tension between two ends. A connector was mounted on one end of a sample cable at least five feet long and the other end of the cable was left exposed. The connector was then attached to a Keithly Model 617 Programmable Electrometer. The electrometer was in turn connected to a Tektronic TDS 540 Digital Storage Oscilloscope.

A set amount of weight was then applied to the exposed end of the cable to place tension upon it. Care was taken to assure that the cable was not in electrical contact with any conductive surfaces and that the conductor and the shield of the cable were not in touch with each other. A cable support post was then placed mid-way between the two ends of the cable to stretch the cable out of the plane between its two ends. The support post was adapted to be removed to release the cable and allow it to vibrate freely between its two ends.

At this stage, the electrometer was calibrated to zero and the oscilloscope was set to record the wave form generated by the vibrating cable. The cable support post was then released, allowing the cable to vibrate freely, and electrical readings were taken.

The response recorded on the oscilloscope was directly related to the current measured by the electrometer as a function of time. If the electrometer is in the 2 picoamp range, the voltage waveform displayed on the oscilloscope represents 1 picoamp current for one volt on the oscilloscope (i.e., there is a 2:1 ratio between electrometer range in picoamps and oscilloscope current range in picoamps for each one volt on the oscilloscope). If the voltage displayed on the oscilloscope is greater than 2 volts, the electrometer was switched to the next higher range and the test was repeated.

EXAMPLE 2

An insulative layer of PFA filled PTFE tape made in accordance with Example 1 was helically wrapped over an AWG 30(7/38) SPC wire to an OD of 0.034" (0.086 cm). A semi-conductive layer comprising an FEP laminated carbon filled PTFE tape was then helically wrapped over the PFA filled tape to an OD of 0.040" (0.102 cm).

The FEP laminated carbon filled PTFE tape was made in the following manner. A slurry of 1574 g of Ketjenblack 300-J carbon black obtained from AKZO Chemicals was slurried with 55.0 l of deionized water in a 30 gallon baffled stainless steel vessel. While the slurry was agitating at 120 rpm, 4633 g of PTFE in the form of a 15.2% dispersion was rapidly poured into the mixing vessel. The PTFE dispersion was an aqueous dispersion obtained from ICI Americas Co. The mixture was self-coagulating and within 1.5 minutes co-coagulation was complete. After 10 minutes, the coagulum had settled to the bottom of the mixing vessel and the water was clear.

The coagulum was dried at 165° C. in a convection oven. The material dried in small, cracked cakes approximately 2 cm thick and was chilled to below 0° C. The chilled cake was hand ground using a tight, circular motion and minimal downward force through a 0.635 cm mesh screen. The resulting powder was lubricated using 1.24 cc of mineral spirits per gram of coagulum. The lubricated mixture was chilled, passed through a 0.065 cm mesh screen, tumbled for 10 minutes, allowed to sit at 18° C. for 48 hours, then re-tumbled for 10 minutes.

A pellet was then formed in a cylinder by pulling a vacuum and pressing at 800 psi. The pellet was heated in a sealed tube and extruded into a tape form.

The tape was then calendered through heated rolls to approximately 10.5 mils. The lubricant was evaporated by running the tape across heated rolls (at 270° C.).

The tape was then expanded at 105 ft/min output speed across heated rollers (at 270° C.) at a ratio of 3:1. The material was laminated to 0.5 mil FEP-100 film across a heated surface while stretching twice at a ratio of 1.3:1 and 1.2:1 at 335° C. and an output speed of 30 ft/min. The bulk density of the tape was 0.187 g/cc and was approximately 6 mils thick.

A wire braid shield layer was then installed in the manner described in Example 1 (AWG 38[(1)] SPC braid with 20 picks per inch and 3 ends) and a closing die was employed to apply compression to an OD of 0.054" (0.137 cm).

Heat treatment was then performed in accordance with Example 1 to activate the adhesive material and bond the insulative layer, semi-conductive layer and shield layer together. Following heat treatment, an extruded jacket of PFA was then installed to produce a finished diameter of 0.070" (0.178 cm).

The final cable had the following properties:

Impedance of 55±5 ohms

Velocity of Propagation of 75%

Capacitance of 25 pico farads/ft

Noise test (voltage) of 6.24 millivolts

Noise test (current) of 2.48 picoamps

EXAMPLE 3

An expanded PTFE tape was prepared with a coating of FEP adhesive. The process set forth in Example 1, above, was followed using 63 lbs of TE-3525 resin blended with 7875 cc of mineral spirits. In the expansion step, the tape was expanded at a ratio of 3.8:1. The expanded tape was laminated to 0.5 mil FEP-100 film across heated surfaces at a temperature of 315° C., a ratio of 1.25:1, and a 46 ft/min output speed. The material was run through heated plates at the same conditions two more times to yield a final bulk density of 0.51 g/cc and 3.1 mils thickness.

The FEP laminated expanded PTFE tape then was helically wrapped as an insulative layer over a silver plated copper wire (AWG 30(7/38) to a diameter of 0.033" (0.084 cm). Using a conventional braiding machine, a braided shield, comprising a AWG 38[(1)] SPC wire with 20 picks per inch and 3 ends, was wrapped over the taped wrapped wire. A closing die was used to apply compression. The braided cable had a 0.056" (0.142 cm) OD. The shielded cable was then exposed to heat in a convection oven of 410° C. for about 10 seconds to activate the adhesive.

Following heat treatment, an extruded PFA jacket was then added with a wall thickness of 0.010" (0.025 cm), producing a final cable OD of 0.072" (0.18 cm).

The final cable had the following properties:

Impedance of 50±5 ohms

Velocity of Propagation of 75%

Capacitance of 29 pico farads/ft

Noise test (voltage) of 37.5 millivolts

Noise test (current) of 2.16 picoamps

EXAMPLE 4

An insulative layer of FEP laminated expanded PTFE tape made in accordance with Example 3 was helically wrapped over an AWG 36(7/44) CS-95 wire to an OD of 0.016 (0.041 cm). A wire braid shield layer was then installed in the manner described in Example 3 only applying a AWG 44[(1)] SPC wire at 30 picks per inch and 3 ends. A closing die was employed to apply compression to an OD of 0.022".

An expanded PTFE tape was then helically wrapped over the braided cable and heated with a contact heater at 410° C. for about 5 seconds was applied to sinter the ePTFE and activate the adhesive. The final diameter of the cable was 0.030" maximum.

The final cable had the following properties:

Impedance of 50±5 ohms

Capacitance of 25 pico farads/ft

Noise test (voltage) of 0.44 mVolts

Noise test (current) of 1.51 picoamps

EXAMPLE 5

It is contemplated that the present invention may likewise be practiced with a variety of other materials serving as the insulative layer. One form envisioned for the present invention comprises forming an insulative layer from a foamed polymer material such as FEP, PFA, or ethylene-tetrafluoroethylene (ETFE). This may be effective in dropping the dielectric constant of the insulation from 2.2 toward 1. The ultimate insulative properties achieved are dependent upon a number of factors, including the material used and the final air content (density) of the material. The following are examples of how the present invention may be practiced using such materials.

Continuous foaming of FEP, PFA, or ETFE resin can be achieved by using a blowing agent (e.g., FREON 22 fluoromethane gas available from E. I. dupont de Nemours and Company) and an extruder. Suitable polymers for use in this process include FEP 100, PFA 340, and CX5010 polymers, all available from E. I. dupont de Nemours and Company. Foaming of the insulation material should be carried out in accordance with the polymer manufacturer's instructions. The following is an outline of suitable procedures for the above listed preferred polymers acquired from E. I. dupont de Nemours and Company.

The blowing agent is dissolved in the resin to equilibrium concentrations, such as by injection in a screw extruder. By adjusting the pressure in the extruder, the amount of blowing agent dissolved in the melt can be controlled. The greater the amount of blowing agent dissolved in the melt, the greater the final void volume of the foam.

For use in the present invention, a single screw extruder, such as that available from Entwistle Company, Hudson, Mass., provided with a medium size screw (e.g., 1.25), should be suitable. Preferably a super shear extrusion process should be used to reduce the temperature of die to about 45° C. below the melt temperature of the resin. Ideally, a five zone extruder should be employed to provide uniform blowing agent dispersion. Other preferred operating parameters include: providing a die with a relatively long land; using either fixed centered or adjustable-centered crossheads; employing shallow entry cone angles; providing careful temperature control, and employing smooth, streamlined tooling (both tip and die); and using high nickel alloy crosshead components. The tip and die size should be appropriately selected for wire and wall thickness (e.g., a AWG 30(7/38) 0.012" conductor with a wall thickness of about 0.0125"). A vacuum should be applied from the rear of the crosshead to pull the insulation tightly onto the conductor.

Foam formation begins as the molt resin passes out of the extrusion die. The blowing agent dissolved in the polymer resin comes out of the resin as a result of sudden pressure drop as the extrudate exits the extrusion die. Foam growth ceases upon cooling, such as when the extrudate enters a water cooling trough.

To produce uniform, small diameter cell structure, a nucleating agent may be employed, such as boron nitride. A 0.5% by weight loading of boron nitride should provide adequate foam cell nucleation. This level of nucleating agent loading can be achieved by blending a cube concentrate resin FEP or PFA containing 5% boron nitride with virgin, unfilled resin. A cube blend of 1 part concentrate to 9 parts unfilled resin will approximate the 0.5% loading. Concentrate resins are commercially available in this form.

The amount of foaming which occurs exiting the extruder is a function of the temperature of the crosshead and should be carefully controlled. Additionally, capacitance and the diameter of the insulation should likewise be continuously monitored as it exits the extruder to assure uniformity.

It is also possible to purchase conductors with a foamed polymer adhesive pre-applied to them, such as foamed polyethylene or foamed polypropylene. Such material is commercially available under the trademark BRAND REX from Brintec Systems Corporation, although use of such conductors in the present invention may require stripping of the jacket and shielding from pre-formed cables.

Once a foamed insulation is applied to a conductor in the manner described above, the wire may then be incorporated into a cable of the present invention. For example, using a AWG 30(7/38) conductor and a fluoropolymer such as FEP or PFA foam with a diameter of 0.036" over the conductor, a braid is applied. One suitable form comprises using AWG 38(1) SPC using a standard 16 carrier Wardwell braiding machines using 3 ends and 20 picks per inch. A closing die 0.051" may be used to apply the braid with compression.

Since the insulation itself is an FEP, PFA, or ETFE polymer material that can also serve as an adhesive, at this stage the entire assembly may be heat treated (e.g., using a convection oven or contact heater) at a temperature of about 390° to 410° C. for 5–20 seconds to bind the insulative layer to the braided shield layer. Additionally, a separate fluoropolymer adhesive may also be applied within the cable to provide even stronger adhesion.

A jacket may then be applied by any suitable method. For instance, a jacket may be applied by wrapping several layers of PTFE jacket material (e.g., three layers of 0.003" thick PTFE tape) on to the braided cable and then sinter it at 390° C for about 10 seconds in a convection oven. Alternatively, a wall of PFA (e.g., 0.007) may be extruded around the braid using standard extrusion technology. The finished diameter is approximately 0.065".

Producing a cable in this manner should produce a cable with approximately the following properties:

Impedance approximately 55±5 ohms

Velocity of Propagation approximately 82%

Capacitance approximately 24 pf/ft

Low Noise Performance

EXAMPLE 6

A fluoropolymer foam insulation (e.g., FEP, PFA, or ETFE) may be applied to a wire in the manner described in Example 5, for instance, using an AWG 30(7/38) wire with an insulated diameter of 0.036". An FEP laminated carbon filled PTFE semi-conductive layer may then be applied to the insulated conductor by wrapping in a helical manner. to bring the diameter to about 0.043". On top of the semi-conductive layer, an AWG 38(1) braid may be applied using 3 ends and 20 picks per inch on a 16 carrier Wardwell braider. A closing die of 0.058" should be used to apply compression. The braided diameter will be 0.059". Once formed in this manner, the insulative layer may be bonded to the shield layer by applying 390° to 410° C. heat for 5 to 20 seconds. A jacket layer may then be applied, such as through helically wrapping the PTFE to the braided cable and applying 390° C. heat for 10 seconds in a convection oven or by applying a 0.007" wall of PFA using standard extrusion technology. The finished diameter should be approximately 0.073".

Producing a cable in this manner should produce a cable with approximately the following properties:

Impedance approximately 50±5 ohms

Velocity of Propagation approximately 73%

Capacitance approximately 27 pf/ft

Low Noise Performance

EXAMPLE 7

Another insulation that may be used in the present invention comprises a polyolefin foam insulation, such as a polyethylene. This insulation can be manufactured using conventional extrusion equipment, such as a 1.5" Entwistle plastic extruder. Pressure extrusion tooling works best and should be selected based on substrate diameter and desired wall thickness. A resin containing a blowing agent is used for this type of extruding. Suitable material can be purchased from a number of sources, such as Quantum Chemical Corporation, Cincinnati, Ohio, under the trademark PETROTHENE. This resin incorporates a compatible blowing agent. Barrel pressures are kept at about 750 to 1200 lb/in$^2$. A typical temperature profile is:

| | Extruder Zone | | | | |
|---|---|---|---|---|---|
| | Feed | 2 | 3 | 4-X | Adapter |
| Temp. (°F.) | 320° | 330° | 350° | 390° | 400° |

The blowing agent must be activated with the higher temperature as it approaches the adapter (cross-head) exit. This temperature setting must be precisely controlled to maintain consistency of foam density. Temperature can also can be used as a controlling variable for foam density.

This polymer foam insulation may be applied to a wire in the manner described in Example 5, for instance, using an AWG 30(7/38) wire and applying the low dielectric polyethylene insulating foam to a diameter of approximately 0.037". This foam insulation will have a dielectric constant of approximately 1.7. To this insulated conductor an AWG 38$^{(1)}$ braid may be applied in the manner previously described. A 0.054" closing die may be used in order to apply the braid with compression. Adhesion of the insulative layer to the shield layer can be achieved by applying 300° C. heat for about 5–20 seconds in a convection oven. The diameter of the braided cable should be approximately 0.055". A jacket may then be applied in the manner previously described to produce a finished cable with a diameter of approximately 0.069".

Producing a cable in this manner should produce a cable with approximately the following properties:

Impedance approximately 55±5 ohms

Velocity of Propagation approximately 81%

Capacitance approximately 26 pf/ft

Low Noise Performance

EXAMPLE 8

A polyethylene foam insulation may be applied to a wire in the manner described in Example 7, for instance, using an AWG 30(7/38) wire and applying a low dielectric polyethylene foam insulation to a diameter of approximately 0.037". This foam insulation will have a dielectric constant of approximately 1.7. A semi-conductive layer may then be applied, such as by helically wrapping a FEP laminated carbon filled PTFE to a diameter of about 0.044". An AWG 38$^{(1)}$ braid may then be applied in the manner previously described. A closing die of 0.056" may be used to apply the braid under compression. A rapid heat treatment at 390°–410° C. may then be performed to bond the insulative layer to the shield. Again, a jacket may be applied, such as by helically wrapping and sintering a PTFE tape or extruding a 0.007" wall of PFA. The finished cable diameter should be approximately 0.075".

Producing a cable in this manner should produce a cable with approximately the following properties:

Impedance approximately 50±5 ohms

Velocity of Propagation approximately 75%

Capacitance approximately 30 pf/ft

Low Noise Performance

While particular embodiments of the present invention have been illustrated and described herein, the present invention should not be limited to such illustrations and descriptions. It should be apparent that changes and modifications may be incorporated and embodied as part of the present invention within the scope of the following claims.

The invention claimed is:

1. A cable for transmission of electrical signals which comprises:

a conductor;

an insulative layer surrounding the conductor;

a shield layer surrounding the insulative layer;

wherein an adhesive bonds the insulative layer in relative position with the shield layer to resist separation and relative movement between the insulative layer and the shield layer during use and to avoid triboelectric currents which can result from such movement; and wherein the adhesive comprises a fluoropolymer adhesive.

2. The cable of claim 1 wherein the insulative layer comprises at least in part an expanded polytetrafluoroethylene (PTFE).

3. The cable of claim 1 wherein the cable includes a semi-conductive layer between the insulative layer and the shield layer to assist in dissipating triboelectric currents.

4. The cable of claim 3 wherein the semi-conductive layer is bonded to the insulative layer and the shield layer with the adhesive.

5. The cable of claim 3 wherein the semi-conductive layer comprises a conductive polytetrafluoroethylene (PTFE).

6. The cable of claim 1 wherein the fluoropolymer adhesive is selected from the group consisting of fluorinated ethylenepropylene (FEP) and perfluoroalkoxy polymer (PFA).

7. The cable of claim 2 wherein the adhesive comprises:

a fluorinated ethylenepropylene (FEP) adhesive layer laminated to the insulative layer; and a perfluoroalkoxy polymer (PFA) adhesive embedded within the expanded PTFE.

8. The cable of claim 1 wherein the adhesive bonds the insulative layer so as to resist relative movement both between the insulative layer and the conductor and between the insulative layer and the shield.

9. A cable for transmission of electrical signals which comprises:

a conductor;

an insulative layer surrounding the conductor;

a shield layer surrounding the insulative layer;

wherein an adhesive bonds the insulative layer in relative position with the shield layer to resist separation and relative movement between the insulative layer and the shield layer during use and to avoid triboelectric currents which can result from such movement; and wherein the cable includes a semi-conductive layer between the insulative layer and the shield layer to assist in dissipating triboelectric currents.

10. The cable of claim 9 wherein the semi-conductive layer is bonded to the insulative layer and the shield layer with the adhesive.

11. The cable of claim 9 wherein the semi-conductive layer comprises a conductive polytetrafluoroethylene (PTFE).

12. A cable for transmission of electrical signals which comprises:

a conductor;

an insulative layer surrounding the conductor;

a shield layer surrounding the insulative layer;

wherein an adhesive bonds the insulative layer in relative position with the shield layer to resist separation and relative movement between the insulative layer and the shield layer during use and to avoid triboelectric currents which can result from such movement; and wherein the adhesive comprises:

a fluorinated ethylenepropylene (FEP) adhesive layer laminated to the insulative layer; and a perfluoroalkoxy polymer (PFA) adhesive embedded within the expanded PTFE.

13. A cable for transmission of electrical signals which comprises:

a conductor;

an insulative layer surrounding the conductor;

a shield layer surrounding the insulative layer;

wherein an adhesive bonds the insulative layer in relative position with the shield layer to resist separation and relative movement between the insulative layer and the shield layer during use and to avoid triboelectric currents which can result from such movement; and wherein the adhesive bonds the insulative layer so as to resist relative movement both between the insulative layer an the conductor and between the insulative layer and the shield.

* * * * *